United States Patent [19]

Bowles et al.

[11] 4,264,226

[45] Apr. 28, 1981

[54] RELOCATE FEATURE FOR AN ELECTRONIC TYPEWRITER

[75] Inventors: David J. Bowles, Winchester, Ky.; Douglas E. Clancy, Austin, Tex.; Carl F. Johnson, Lexington, Ky.; Danny M. Neal, Austin, Tex.

[73] Assignee: International Business Machines Corporation, Armonk, N.Y.

[21] Appl. No.: 908,326

[22] Filed: May 22, 1978

[51] Int. Cl.[3] ..... B41J 29/42

[52] U.S. Cl. ..... 400/709.1; 400/279; 400/697.1

[58] Field of Search ..... 400/293, 347, 709, 709.1, 400/709.2, 536, 537, 538, 279, 280, 290, 306, 309, 76, 697.1

[56] References Cited

U.S. PATENT DOCUMENTS

| | | | |
|---|---|---|---|
| 3,547,245 | 12/1970 | Okcuoglu et al. | 400/347 |
| 3,780,846 | 12/1973 | Kolpek et al. | 400/697.1 X |

OTHER PUBLICATIONS

IBM Technical Disclosure Bulletin, "Carrier Positioning", Petterson, vol. 17, No. 4, Sep. 1974, p. 956.

*Primary Examiner*—Ernest T. Wright, Jr.
*Attorney, Agent, or Firm*—Laurence R. Letson

[57] ABSTRACT

On electronic typewriters which have the ability to record into a small working memory those characters, functions and escapements which are keyed at the keyboard, it is many times advantageous to be able to place the carrier and the print point over a character which has been previously typed without using repeated backspaces. Disclosed herein is a feature for an electronic typewriter which permits the operator to easily align the print point with a character on the page by positioning a reference mark on the card holder or print carrier in relation to a previously printed character and then through keyboard control cause the carriage to shift its position such that the print point is then exactly aligned with the character printed. The positioning of the carrier such that the reference mark is in relation to the desired print point is accomplished by a backspace operation and the repositioning or causing of the carrier to assume a position immediately over the subject character is accomplished by keyboard control through the electronics of the typewriter to cause the carrier to shift a predetermined distance.

3 Claims, 8 Drawing Figures

RELOCATE FEATURE FOR AN ELECTRONIC TYPEWRITER

BACKGROUND OF THE INVENTION

In typewriters having the ability to position the print point at any of several different positions within a normal escapement pattern, such as for example, in those using a conventional lead screw type of escapement arrangement, it is possible to either intentionally or inadvertently create misalignment with the normal escapement pattern. A lead screw escapement arrangement is commonly used since such a system is conducive to the implementation of proportional spacing. Particularly in proportional spacing typewriters, it is difficult to reposition the print point over a previously printed character because of variances in character width. This repositioning can also be difficult where the print point at some point in the line has been misaligned either intentionally or inadvertently such as for example where a character has been squeezed in or where characters have been removed and then subsequent printed characters have been expanded to fill the space. In situations such as that immediately described above it is difficult to realign the print point with those positions for the removal and correction of erroneously typed characters. When the operator attempts to align the character it is dependent upon the operator's ability to visualize intersections of guide marks with edges or centers of characters and this does not lead to accurate reliable positioning. Thus when the operator attempts to remove the character from the page by erasure through the use of the corrections mechanism on such a typewriter the characters are not properly aligned and either ghost images remain on the paper or repetitive corrections at small escapement increments are necessary, thus thereby potentially tearing the page.

On some typewriters it has been necessary to provide an extendable guide member which may be extended into the print point area to facilitate repositioning. This member must of necessity be retractable in order to not interfere with subsequent printing operations. Other solutions have included guide marks on the card holder or other reference marks which the operator must observe and attempt to align with the desired print position. Due to the necessity for clearance between the impacting print element and the card holder or other structure in that area, it is many times necessary to displace these reference marks by some distance from the actual print point thereby increasing the possibility for misjudgments. This is particularly true where the typewriter is capable of positioning the print carriage in very small increments of a full escapement increment.

It is therefore, an object of this invention to facilitate the alignment of the print point of the typewriter with a desired location on the printed page.

It is an additional object of this invention to ease the operator's burden in relocating the print point over a desired position on a printed page.

It is an additional object of this invention to electronically move the carriage from a preliminary alignment position to a final alignment position thereby insuring accurate relocation of the print point over a particular position on a page.

SUMMARY OF THE INVENTION

The relocate mode of operation in the electronic typewriter is accomplished by positioning the carriage of the typewriter such that a reference mark on the card holder or other structure of the carrier is positioned immediately to the left of that character over which it is desired to relocate the print point of the carrier. This may be accomplished by using the backspace operation of the typewriter by itself or in conjunction with a one unit backspace operation which permits the movement of the carrier and print point by one escapement unit where the normal escapement increments for the typed characters are either uniform and multiple units or where they vary and are comprised of multiple escapement units. Upon the location of the guide mark in the desired position, it is then possible for the operator to enter through the keyboard, by means of the alternate function key or code key and an alphanumeric key on the keyboard, an instruction to cause the print point to move in a leftward direction by a predetermined distance when the typewriter is in the proportional spacing mode. This predetermined distance corresponds exactly to the distance between the reference mark on the carrier or card holder and the print point. When the typewriter is in either of the standard 10 or 12 pitch spacing modes, this distance is either exactly the distance between the reference mark on the carrier or card holder and the carrier print point or the distance between the reference mark and a predefined character position. By this means, automatic compensation is made for initial misalignment of the reference mark at the left edge of standard spacing characters. Thus when such a relocation command is entered from the keyboard, if the reference mark on the card holder has been properly positioned with respect to the new desired print point location, the carrier will relocate itself over that point such that the print point previously impacted at that location and the chosen print point coincide exactly.

After the print point has been re-aligned by following the above sequence of events, the typewriter may then be conditioned for erasure so that a character, which is either not in memory or where the memory is not in coincidence with that on the printed page, can be removed. This is accomplished by the depression of the erase key on the keyboard which through the electronics causes the typewriter to enter an erase condition and to condition the electronics so that upon the next alphanumeric key button depression the typewriter will not escape and the correction media will be placed between the type element and the character on the printed page. After the depression of the erase key the character key corresponding to the erroneous character to be removed from the page is depressed and the typewriter accomplishes a printing cycle with two exceptions, those being the insertion of the correction media between the type element and the page to effect correction and the nonescapement of the carrier upon the completion of the printing cycle. This leaves the print point aligned with that position on the page where a new character may be typed if so desired.

Thus it can be seen that with the ability to relocate the print point by use of an off position indicator mark and the ability to then back the carrier up by a predetermined accurately defined distance will remove a large portion of the possibility for error in relocating the print element over the desired point on the page. This will also enhance the ability of the operator to operate the machine in a rapid and efficient manner and produce quality typed copy.

DESCRIPTION OF THE INVENTION

Figure 1:
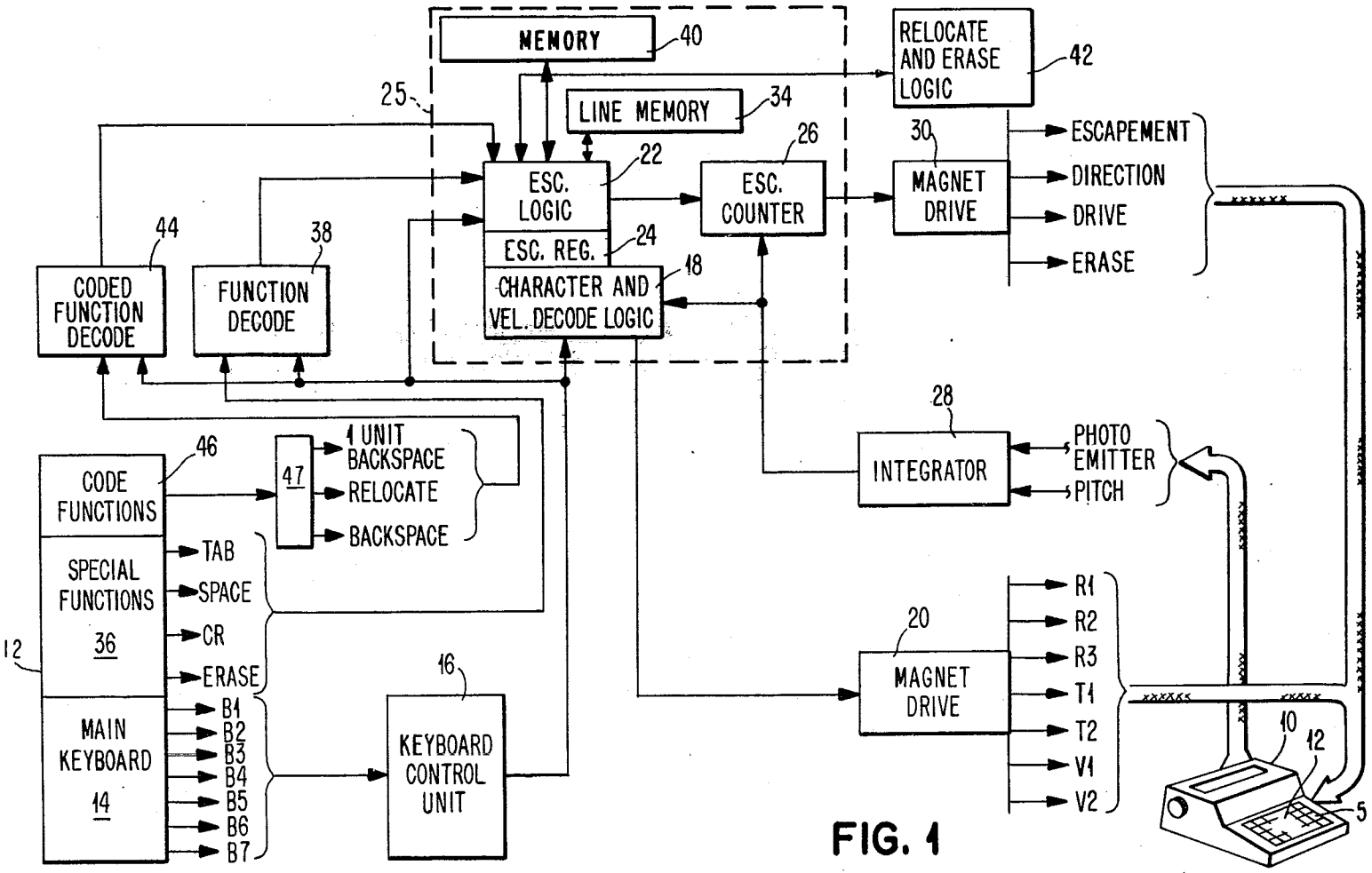
FIG. 1. is a block diagram representing the electronic controls and system which operate the typewriter.
Figure 2:
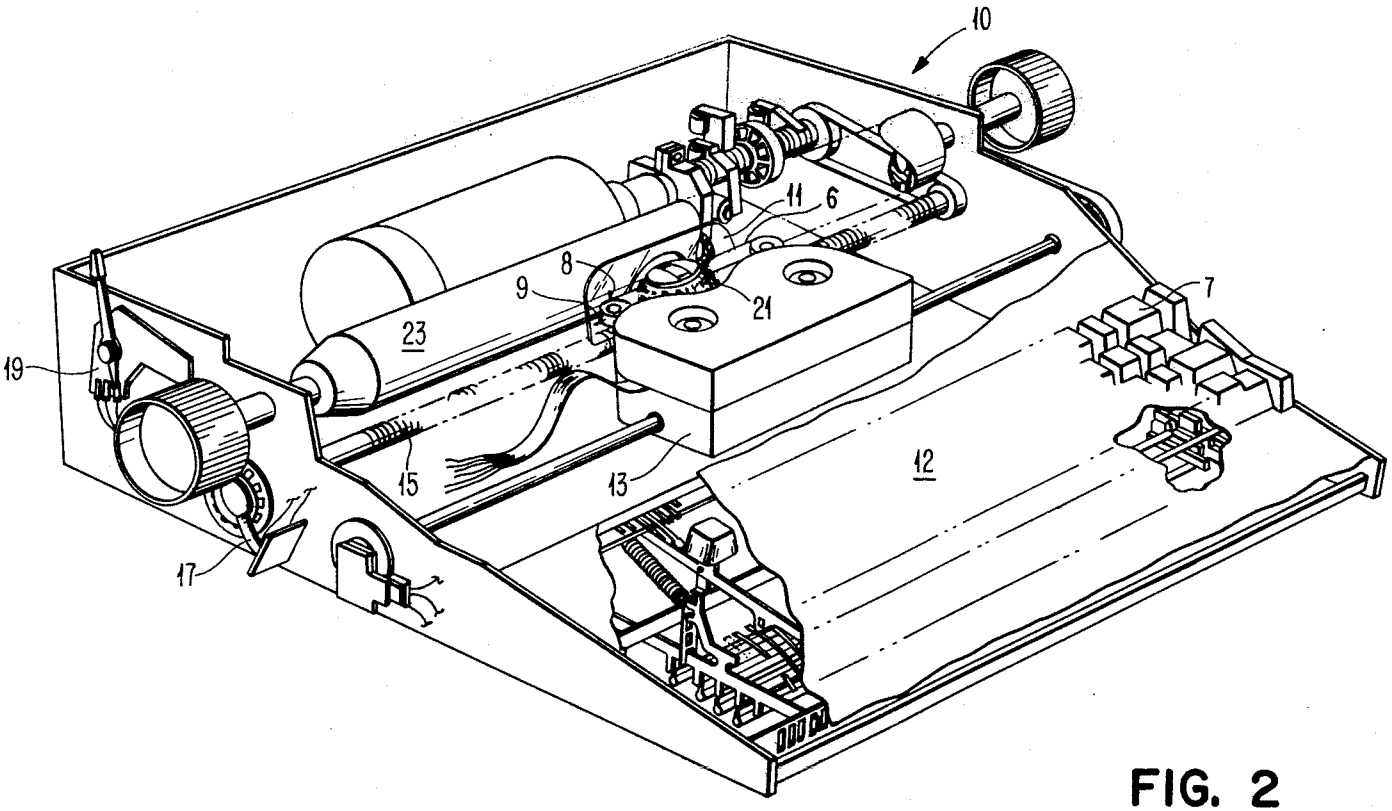
FIG. 2 illustrates the drive mechanism and appropriate inputs to the electronics and hardware of the printer itself, including the print carrier card holder and reference mark.

For purposes of description, it is assumed that the typewriter 10 of FIG. 1 is in operation and that typing has occured in a normal, conventional manner and that the characters as they are typed are stored in a line memory 34, which upon a carrier return is erased to provide the capacity to store characters from the next line. The operator from time to time may desire to make corrections in text which has been typed previous to the last carrier return and not be able to access the characters from the line memory 34. When this condition exists, the operator need only to roll the platen 23 back to the apropriate line and to insure that the print line is appropriately vertically aligned with the horizontal guide marks 9 on the card holder 11 of the typewriter 10. When the operator has completed the re-alignment of the print line in which the error occured with the guide marks 9 on the card holder 11, then by use of a space command, tabulation command, or a backspace command or a combination of any of these it is possible to place the carrier 13 in proximity to the erroneous letter. Final positioning of the reference mark 8 over the erroneous letter position may be accomplished by backspace, space and use of the one unit backspace. Use of the one unit backspace is particularly beneficial in proportional space typing due to the variation in widths of the letters typed.

Referring to FIG. 1, the tab and space commands which emanate from the special functions section 36 of keyboard 12, are routed to the function decode 38 and are determined to be either tabulation commands or spaces and thus turns over the control to escapement logic 22. The escapement logic 22, for a tab command, will access the memory 40 and determine the next rightmost tab position. This information is then stored into the escapement register 24 and the escapement counter 26 is loaded with the difference between the present position of the carrier 13 and the position represented by the tab stop. Then the escapement counter 26 after being loaded affects the magnet drivers 30 to cause forward escapement. As the forward escapement, drive and direction magnet drivers 30 are activated this creates motion in the lead screw 15 of the typewriter 10. As the lead screw 15 rotates and the carrier 13 translates, the photoemitter/sensor 17 together with the pitch selection switch 19 will provide inputs to the integrator 28 which in turn will then decrement the escapement counter 26 until the value therein is equal to zero. At this point the magnet drivers 30 causing the forward escapement and effecting the tabulation are turned off.

A similar routine is accomplished for the normal space commands with the exception that the value inserted into the escapement counter 26 represents the standard escapement for a space. This value will depend upon the configuration of the typewriter 10 but may typically be six units for a 10 pitch mode, five units for a 12 pitch mode or four units for proportional space.

If upon the placing of the reference mark 8 on the card holder 9 in the vicinity of the position where it is desired to relocate the print point, the reference mark 8 is not exactly aligned with the left edge of the character occupying that position on the printed page, then the reference mark 8 should preferably be to the right of the left edge of that character so that by the use of the one unit backspace the carrier 13 may be reverse escaped one unit of escapement and thereby move the reference mark 8 leftward until it aligns with the left edge of the character occupying that position on the page.

The one unit backspace is accomplished by the use of the alternate or code function 46 and an alphanumeric key code B1–B7 from the main keyboard 14. This combined signal is passed through the coded function decode 44 to determine which of the functions is being encoded from the keyboard 12. After that signal has been decoded the output is fed to the escapement logic 22, the escapement logic 22 then causes an updating of the escapement register 24 to a value one escapement unit less than that presently occupied by the carrier 13 and the escapement counter 26 has a value of one inserted therein. Upon the escapement counter 26 being loaded the magnet drivers 30 are then affected to cause a reverse escapement and drive. Upon the receipt of the first emitter pulse the integrator 28 will then decrement the escapement counter 26 to zero which upon having a zero value will then shut off the magnet drivers 30.

Block 47 is utilized to show that one unit backspace, backspace, and relocate all emanate from the coded functions section 46 of keyboard 12. Upon the positioning of the reference mark 8 on the card holder 11 or carrier 13 accurately at the left edge of the character occupying the desired print point on the page, the alternate or code function 46 is utilized together with another alphanumeric key code B1-B7 designated as the relocate code. This function is likewise passed through the coded function decode block 44 which determines that the signal received from the keyboard 12 is a relocate command. The escapement logic 22 recognizes the input from the coded function decode logic 44 as a relocate command and passes control to the relocate and erase logic 42. The relocate and erase logic 42 determines the distance necessary to reverse escape the carrier 13 to place the carrier 13 over the print position desired by the operator. In the event that the typewriter 10 is in proportional spacing mode, the distance determined is sixty escapement units. If the typewriter 10 is in either the 10 or 12 pitch standard spacing mode, the relocate and erase logic 42 will then determine whether the point to which the carrier 13 will be reverse escaped using the normal sixty unit reverse escapement will place the carrier 13 at a predefined character position. If the determination is that the character position and the carrier position at that point will not correspond, the relocate and escapement logic 42 determines the additional number of escapement units necessary to cause the carrier 13 to be positioned directly over the fixed, predefined print position in the selected pitch. Upon this determination, the appropriate value is transmitted to the escapement logic 22 together with an indication that the value should be subtracted from the present carrier position on the line and the escapement register 24 loaded with the results. The escapement logic 22 under the control of the relocate and erase logic 42 will then load the escapement counter 26 with either sixty or the corrected value determined by the relocate and erase logic 42 necessary to effect the proper positioning of the carrier 13.

With the magnet drivers 30 turned on and the reverse escapement occuring, the photoemitter/sensor 17 pulses and the pitch selection switch 19 provide the necessary inputs which pass through the integrator 28 and act to decrement the escapement counter 26. When the escapement counter 26 has been decremented to zero this will effect the turning off of the magnet drivers 30. The value of sixty escapement units corresponds to one inch which is likewise the distance between the left edge of the print point of the carrier 13 and the reference mark 8 on the card holder 11. Thus upon the reverse escapement of sixty units, or the corrected value of escapement units determined by the relocate and erase logic 42 as necessary to effect the proper positioning of the carrier 13, the print point of the carrier 13 is positioned such that the left edge thereof exactly corresponds with either the point which the reference mark 8 occupied prior to the relocate command being keyed by key 5 from the keyboard 12, or the print point is positioned at a predefined character position as determined by the relocate and escapement logic 42 and effected by loading the escapement counter 26 with the corrected escapement value. As can be seen, this effectively and precisely places the carrier print point over the point designated by the operator when the reference mark 8 was aligned as desired on the page.

Upon the receipt of the decoded relocate command through the escapement logic 22, the relocate and erase logic 42 sets flags in the memory 40 (by way of escapement logic 22) of the electronics 25 to indicate that the next erase function keyed from the keyboard 12 will not be an automatic erase of the type described in U.S. Pat. No. 3,780,846 issued to Robert Kolpek and assigned to International Business Machines Corporation, but rather will be an erase which must be controlled from the alphanumeric keys of the keyboard 12.

After relocation has been effected with the flags being set as discussed previously, the erase command may be keyed from the keyboard 12. From the special functions section 36 of the keyboard 12 the depression of the erase key 7 will cause a signal to be sent to the function decode logic 38. The signal will result in the function decode logic 38 outputting a decoded signal to the escapement logic 22. The escapement logic 22 is controlled as a result of the relocate sequence described above, to condition the erase magnet driver 30 and to not effect an escapement. Inasmuch the print point of the carrier 13 is directly positioned over the print point on the paper at which the correction is to take place, the escapement logic 22 will recognize this condition since the relocate and erase logic 42 will have commanded it through the setting of flags in the electronics 25 not to effect the escapement but only to cause the turning on of the erase magnet driver 30 on the next cycle. Subsequent to the erase key 7 being used in the typewriter 10, any key on the keyboard 12 may be depressed. The alphanumeric key depressed should of course be the character which is desired to be removed from the printed page. If that character is depressed the signals will emanate from the main keyboard 14 and pass through the keyboard control unit 16 to the character and velocity decode logic 18 and at the same time pass to the escapement logic 22. The escapement logic 22 having then been preconditioned by the erase command and the previous relocate signals will not effect any escapement on this cycle. The character and velocity decode logic 18 will then decode the signals received from the keyboard control unit 16 and turn on the appropriate magnet drivers 20 for the selection of the rotate, tilt and velocity with those drivers 20 producing rotate signals R1, R2, R3; tilt signals T1 and T2; and velocity signals V1 and V2. Thus the machine will cycle and the appropriate character, as keyed from the keyboard 12, will be selected on the print element 21 and impacted onto the page. Inasmuch as the erase magnet driver 30 has been preconditioned on the previous cycle the erase media 6 will then be interposed between the print element 21 and the page and thus effect erasure. No escapement will occur due to the control from the relocate and erase logic 42 and therefore, the carrier 13 will remain over the print point for subsequent printing of corrected characters.

For second and third character erasures, the relocate and erase logic 42 again is in control. To erase the next preceding character and other earlier printed characters, the sequence of operations is the depression of the erase key 7 and then the depression of the character key on the keyboard 12 corresponding to the character to be removed from the paper. Upon the depression of the erase key 7 the function decode 38 will decode the signals received from the keyboard 12 and pass them to the escapement logic 22 which, under the control of the relocate and erase logic 42 will cause the escapement logic 22 to be prepared for a character key on subsequent keyboard cycles. The relocate and erase logic 42 will likewise condition the magnet drivers 30, by way of escapement logic 22 and escapement counter 26, for erase upon a subsequent operation, in the appropriate sequence. The depression of a character key on the main keyboard 12 will result in bail codes B1 through B7 selectively emanating from the main keyboard 14 to the keyboard control unit 16 where these signals will then be transmitted to a character and velocity decode logic 18 appropriate for the characters. At the same time this information will likewise be sent to the escapement logic block 22. The escapement logic 22 having been conditioned by the relocate and erase logic 42 will then receive the character from the keyboard control unit 16 and will cause a reverse escapement by the appropriate distance necessary for that character.

In fixed pitch print operation the appropriate distance will be determined by the pitch while in proportional spacing that distance will be determined by the character itself. The escapement logic 22 will then update the escapement register 24 with the destination value for the carrier 13 and will insert the distance to be backspaced into the escapement counter 26. Upon the escapement counter 26 being loaded, the magnet drivers 30 for escapement, direction and drive will be turned on effecting the reverse escapement. Upon the completion of that reverse escapement movement of the carrier 13, the escapement logic 22 through the escapement register 24 will cause the character and velocity decode logic 18 to effect the appropriate rotation and tilt of the type element 21 together with the appropriate velocity selection. Additionally, under the control of the relocate and erase logic 42, the escapement logic 22 will turn on the magnet driver 30 for the erase magnet effecting the positioning of the erase media 6 between the type element 21 and the platen 23 thereby causing correction of the character upon the proper rotation, tilt and impact of the type element 21 against the erase media 6.

Subsequent to the removal of all incorrect characters as controlled by the operator in a sequence as described above, normal typing may be resumed to insert the appropriate characters if desired.

The controls necessary to control the typewriter 10 which have been explained above in block diagram form are preferably embodied in operational sequences of the electronic logic and devices of FIG. 1 which may be represented by the flow charts in FIGS. 3 through 7.

Figure 3:
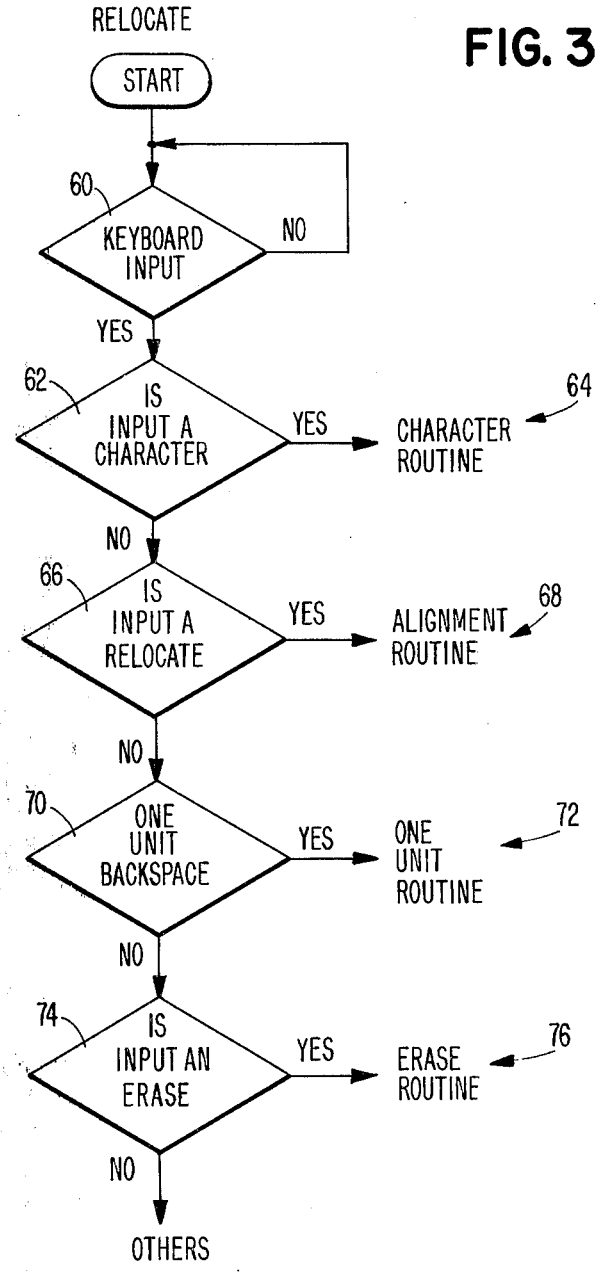
FIGS. 3 through 7 are flow diagrams of the logic flows which the electronics in FIG. 1 performs to appropriately command the drive and printing mechanisms of the typewriter.

To more fully understand the operational sequences and logic controls which are a part of the block diagram illustrated in FIG. 1, reference is made to FIGS. 3 through 7. Referring to FIG. 3, the flow for the logic necessary to start a relocate sequence is illustrated.

Referring to FIG. 3, the main flow of the logic contained in the relocate and erase logic block 42 of FIG. 1, is illustrated in conventional flow chart form. Referring to FIG. 3, progressing from the start point to the first decision block 60, any signals being generated by the code functions section 46, special functions section 36, or main keyboard 14 are passed through decision block 60 to determine whether there is a keyboard input. If the signal inputted to the logic 42 is not a keyboard input then the flow path branches back to start and the keyboard input decode 60 continues to wait until another signal is received. If the signal received is in fact a keyboard input then the yes path is followed and a second decision 62 determines whether the input represents a character. If the input is a character the flow follows the yes branch to the character routine 64. The character routine 64 will be discussed and described more completely later.

If the input is not representative of a character the no branch is followed to the relocate command decision block 66. If the input represents a relocate command then the flow path branches to the alignment routine 68 through the yes path and the alignment routine 68 takes over control. The alignment routine 68 will be more fully discussed below. If the input is not a relocate command the no path is followed to determine if the input is a one unit backspace command 70.

If the input represents a one unit backspace command the yes path is followed to a one unit backspace routine 72 which will be more fully described below.

If the answer to question "is the input a one unit backspace?" 70 results in a "no" answer then the input is queried to determine whether it is an erase command 74. If the input is in fact an erase command the logic 42 will then branch to the erase routine 76 to be discussed further below. If the input is not an erase command it is then concluded that it is some other command from the keyboard 12, 14 which is not relevant with respect to this invention and therefore need not be discussed. The logic flow will then branch to other routines controlling other non-essential functions.

The alignment routine 68 which is commanded from the keyboard 12 by the depression of the code or alternate function button and the alphanumeric key button designated as relocate is initiated without regard to the machine control of the position of the carrier 13. It is totally keyboard controlled at the operators option. The proper performance of the sequence is based upon the assumption that the operator has placed the guide mark 8 or reference mark 8 on the carrier 13 and/or card holder 11 of the typewriter 10 over a point immediately to the left edge of a character which the operator wishes to correct or remove from the paper.

Upon the determination in FIG. 3 that the command received by the logic from the keyboard 12 is a relocate command 66 and the branching of that logic flow to the alignment routine 68, the logic 42 will then place a value which is equal to the number of escapement units in one inch 80, into the escapement counter 26. Upon the storing of this information the pitch is detected to determine whether the carrier 13 of the typewriter 10 is in a fixed pitch mode of operation 82. If the carrier 13 is in a fixed pitch mode the yes path is followed to the decision block 84 which determines whether the carrier 13 at the time of the relocate keyboard command is located over a character position. If the answer to the determination is "yes" the flow branches back to the line designated A1. If the carrier 13 is not located on a character position as defined by the respective pitch, the logic 42 will then branch through the no path. Upon the branching through the no path the distance between the present carrier position and the next character position to the left is determined and is added (block 86) to the escapement counter 26. This will result in the escapement counter 26 containing a value corresponding to one inch of escapement units plus the additional incremental value added to cause the carrier 13 to be moved to the next left character position.

Upon the completion of the adjustment of the value in the escapement counter 26, the logic 42 will branch back to path designated A1. If the pitch determination results in the conclusion that the typewriter 10 is operating in a proportional space mode where the escapement for each character is not fixed then the no path (A1) is followed. The logic 42 then causes the turning on of a manual erase flag (block 88) in the electronics 25 and a first time flag to be set in the electronics 25 also. The effect of turning on the manual erase flag is to provide an indication to the logic 42 that the character to be erased in a subsequent erase routine is to be selected from the typewriter keyboard 12 as opposed to being selected from a stored character.

The first time flag is used so that subsequent logic routines will not effect backspace upon the depression of the character key on the first correction cycle following the relocation movement of the carrier 13.

After the setting of the flags, a special code is then placed into memory (block 90) which is then subsequently used to determine when the erase cycles have ceased and the normal printing cycle is resumed by the removal or cancellation of that special code upon the depression of a character key in a printing mode.

Upon the completion of the placement of this code in the electronics 25 the logic 42 then effects the reverse escapement in an amount equal to the number of units corresponding to the value loaded (block 92) into the escapement counter 26, that value having been previously determined earlier in this routine.

Figure 5:
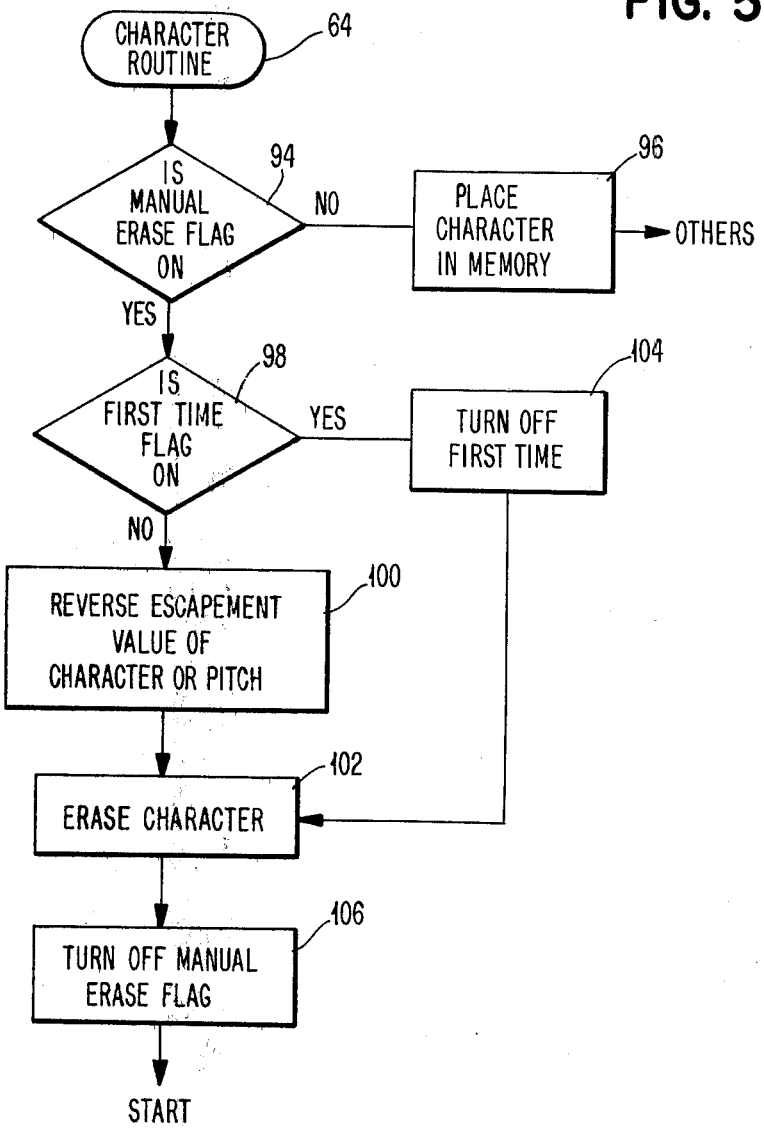
Figure 7:
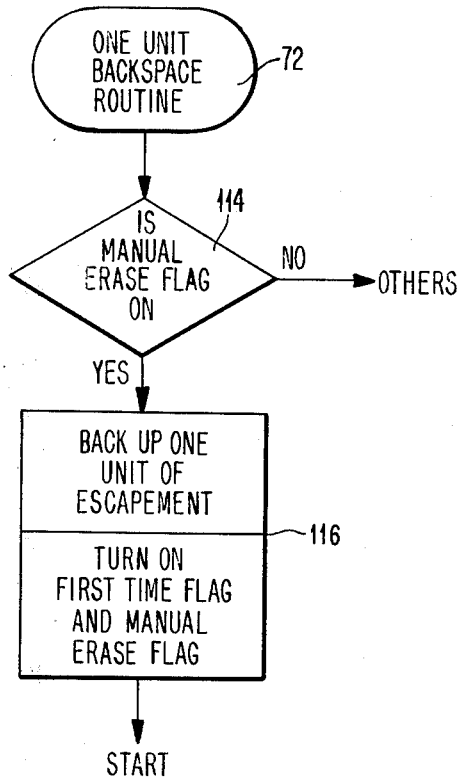

Referring to FIG. 5, the character routine 64 will be described. The character routine 64 is entered as a result of the decision made with respect to the signal received from the keyboard 12 indicating that the signal represents a character (block 62), as previously described with respect to FIG. 3.

Again referring to FIG. 3, the yes path of the decision block 62 with respect to "is the input from the keyboard a character?" will pass the logic flow to the decision block 94 for the determination "is the manual erase flag on?". If the manual erase flag is not on, then that character code is placed into the line memory 34 (block 96Z). The output from line memory 34 then results in signals being sent to sections of the typewriter 10 which align the character, for the normal erase sequence and print the character in a normal manner.

Figure 4:
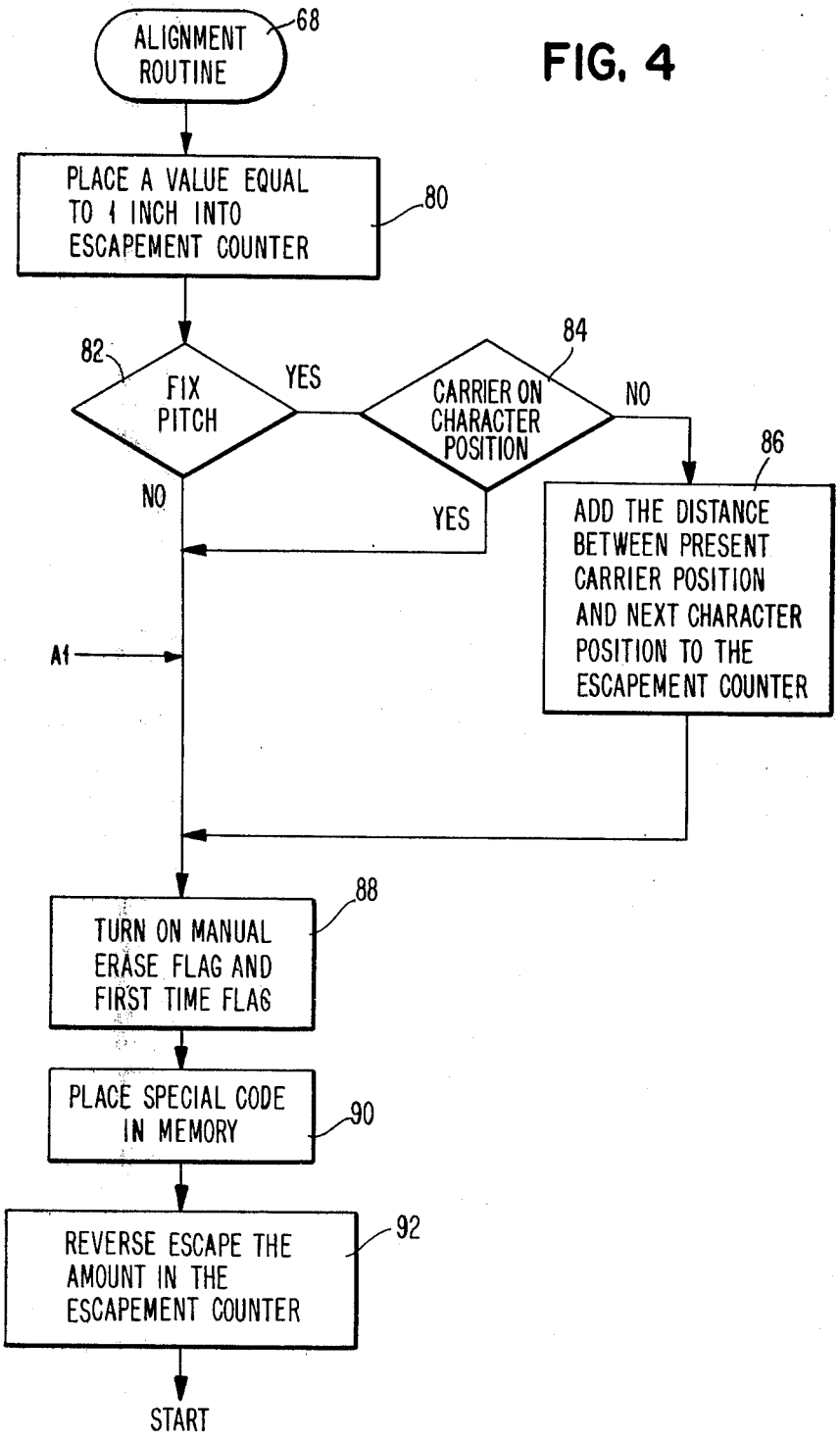

If the manual erase flag is on as was described with respect to FIG. 4, logic 42 may inquire as to whether the first time flag is likewise (block 98). If the first time flag is not on the logic flow results in the reverse escapement of the carrier 13 by a distance corresponding to the escapement value of the character or the escapement value assigned to the particular pitch 10 or 12 characters per inch (block 100), in which the typewriter 10 is operating.

The character may then be erased (block 102) by the receipt of a character code signal as decoded by the character and velocity decode 18 in conjunction with the control of the appropriate magnet drivers 30 to effect the placing of the typewriter 10 into a control mode corresponding to correction.

Returning to the "is the first time flag on?" decision block 98, if that decision is yes, the logic flow branches to turn off the first time flag (block 104) and then flows to the erasing of the character (block 102) as just previously described. The effect of this is to circumvent the reverse escapement on the first correction cycle from the keyboard 12 after a relocation routine FIG. 3 has been performed, since the carrier 13 is properly positioned for the first correction cycle.

After the character has been erased, the manual erase flag (block 106) is turned off and the routine returns to the start point as illustrated in FIG. 3.

Figure 6:
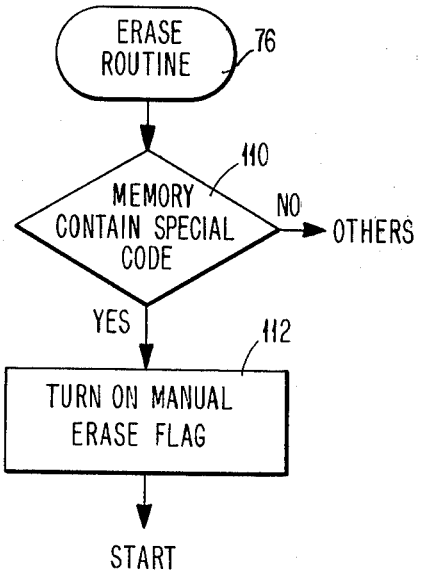

Referring to FIG. 6, upon the branching to the erase routine 76, the memory 40 of the electronics 25 is querried to determine whether it contains the special code (block 110) which was described previously. If there is no special code, then the no path is followed to other functions, for example, the conventional automatic erase routine of the typewriter 10 which does not have any relevance to this invention and is therefore not described in detail.

If upon interrogation of the memory 40 of the electronics 25 a special code is present which has been inserted as a result of an earlier described routinee (block 90), the yes path is followed and effects the turning on of the manual erase flag (block 112) to indicate to the electronics 25 that the next character to be erased must be selected from the keyboard 12.

At this point the logic 42 returns to the start of the entire routine in FIG. 3 on the next keyboard input.

If the keyboard input has been determined to be a one unit backspace signal (block 72), the logic 42 branches to determine if the manual erase flag is on (block 114). If the manual erase flag is not on then the branch causes the logic 42 to flow to other routines.

If the manual erase flag is on, the yes flow path is followed and the first time flag is then turned on. Upon the turning on of the first time flag, the control is passed to the logic 42 which in turn causes the reverse escapement by one escapement unit. Upon the completion of the reverse escaping of one escapement unit, the flow branches back to the start of the routine in FIG. 3.

The one unit backspace routine (block 72) would be entered by the operator, if the operator were to notice that the alignment of the carrier 13 deviated from that of the character to be erased by one unit such as in the situation in which an attempt has been made to erase the character and due to one or more escapement unit misalignment, the character was not properly removed. Thus by using the one unit backspace routine (block 72), the carrier 13 is repositioned to create proper alignment and at the same time prevents the further reverse escapement upon the next character input from the keyboard 12 after an erase command. The routine requires checking for the manual erase flag (block 114) and if found reverse escaping one unit and turning on the first time and manual erase flags (block 116).

Upon the completion of the reverse escaping by one unit (block 72), the logic 42 then reverts to the start as shown in FIG. 3.

The embodiment which this invention may take may be in one of several alternative forms. The form described above in conjunction with the block diagrams and flow charts illustrates one embodiment. An alternative embodiment may be an electronic processor found in FIG. 8 which may operate in conjunction with a permanently configured read only storage 128 in which a series of instructions and codes are to be stored to control the accumulator 126. This electronic apparatus would correspond to the apparatus as described in conjunction with FIGS. 3 through 7.

In such a case, as an alternative to the flow diagrams illustrated in FIGS. 3 through 7, codes or commands may be stored in the read only storage 128 to cause the electronics 25 to process the information from the keyboard 12 and to control the printer 10 in a predetermined sequence of steps. The commands and codes stored in the read only storage 128 may take the form of those attached in Appendix A and Appendix B. Appendix A is a listing of definitions which identify and are associated with particular registers or particular bits within a byte and equates those register designations and/or bit designations with mnemonics. These registers are any storage locations of the Random Access Memories 124, 122 in conjunction with accumulator 126. The B Register 120 is designation for a temporary storage location accessable through Indirect RAM 122.

Appendix B is the complete listing of a set of instructions which serve to control the processor (FIG. 8) and which may be programmed or coded as desired in order to control the electronic processor to perform these routines. Particular embodiments of the code or instructions may be modified as desired by one skilled in the art to accomplish the particular functions of the invention. Additionally it should be recognized that a programmable processor may employ a program which may be written in several forms conforming to the requirements of that processor but which will still accomplish the same result.

Referring to Appendix B, Column 1 is the address, in hexadecimal code, where that particular insturction and is stored. Column 2 represents the hexadecimal code for the instruction and is stored in the location designated by the corresponding information in Column 1. Column 3 is the mnemonics identifying the start point of particular sub-routines.

Column 4 is the mnemonics for the instruction which the processor then executes. Column 5 contains mnemonics which then, through definitions and equality statements in Appendix A assigns numerical values for registers or bits as appropriate for the instructions contained in Column 4. Column 6 contains explanatory comments.

Appendix C includes a listing of the instructions, the mnemonics representing these instructions and two columns designated respectively first byte and second byte having also bit positions indicated numerically.

With reference to those bytes illustrated in the two byte columns, these represent how that particular instruction would appear in the read only storage 128. The ones and zones in those bytes are dedicated values which remain unchanged for that particular instruction while the B's contained in the instruction code indicate the bits to be tested and the A's are representative of the address to which the instruction series will branch upon the meeting of particular conditions set forth, depending upon whether the bits B are represented by a one or zero. Referring to other instructions, the letter D represents a fixed value in memory and is determined by the individual implementing the particular device.

The R's are representative of the numerical designation for one of thirty-two separate registers which are available for storage of data and which are available to the processor. These registers are not dedicated storage locations but are arbitary designations and the registers are random storage in RAMs 122, 124 in conjunction with accumulator 126.

Appendix D includes an instruction summary which lists the mnemonic, the name of the instruction represented by the mnemonics and a brief description of the function performed by the processor as a result of that particular instruction.

Figure 8:
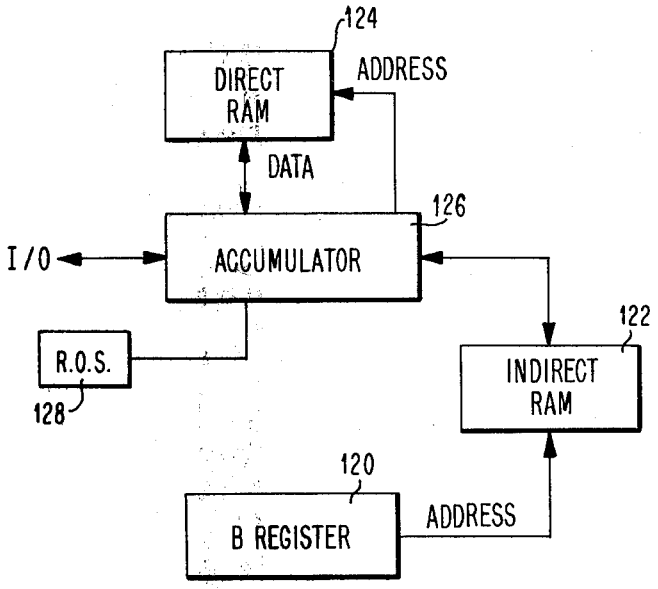
FIG. 8 illustrates the arrangement of a register, memories and an accumulator to be utilized in conjunction with the material in Appendices A–D.

As an aid to understanding the description of the instructions contained in Appendix D, a reference should be made to FIG. 8, which is illustrative of the flow of the instruction between different registers, memories and accumulators. FIG. 8 would in effect be a replacement for all the electrical components within box 25 and boxes 16, 18, 38, 42, 44 and 47, with the I/O line representing keyboard 12 and magnet driver 20,30 connection.

While the invention has been particularly shown and described with reference to preferred embodiment(s) thereof, it will be understood by those skilled in the art that the foregoing and other changes in form and details may be made therein without departing from the spirit and scope of the invention.

APPENDIX A

| | | |
|---|---|---|
| LCNT | EQUALS 2 | ADDRESS OF PRESENT CARRIER POSITION |
| MINI | EQUALS 3 | SUBADDRESS OF PRESENT CARRIER POSITION |
| MLCNT | EQUALS 4 | MEMORY LINE COUNT, ADDRESS LINE MEMORY |
| KBD | EQUALS 5 | KEYBOARD RESISTER |
| PM | EQUALS 6 | PRINTER MAGNET REGISTER, REPESENTS OUTPUT TO PRINTER |
| REVMAG | EQUALS 1 | REVERSE MAGNET |
| ESCMAG | EQUALS 3 | ESCAPEMENT MAGNET |
| SENSOR | EQUALS 9 | REGISTER THAT CONTAINS INPUT SENSORS |
| EMT | EQUALS 2 | EMITTER REPRESENTS ONE UNIT OF ESCAPEMENT |
| ECNT | EQUALS 8 | UNITS OF ESCAPEMENT REGISTER |
| WK1 | EQUALS 7 | WORKING REGISTER |
| FLAG | EQUALS 10 | REGISTER THAT CONTAINS DECISION BITS |
| ESCTABL | EQUALS 100 | TABLE THAT CONTAINS ESCAPEMENT VALUES OF CHARACTERS |
| VELTABL | EQUALS 200 | TABLE THAT CONTAINS VELOCITY VALUE OF CHARACTERS |
| ERTAPE | EQUALS 3 | ERASE THT LIFT MAGNET |
| VELMAG | EQUALS 4 | MAGNET THAT SELECTS VELOCITY OF IMPACT |
| CHARMAG | EQUALS 5 | MAGNET THAT SELECTS CHARACTER |
| STRB | EQUALS 0 | INDICATES THAT THERE IS A KEYBOARD INPUT |
| KBDBLS | EQUALS 255 | REGISTER THAT CONTAINS KEYBOARD INPUT |
| MANUAL | EQUALS 1 | MANUAL ERASE MODE FLAG BIT |
| FIRST | EQUALS 2 | FIRST MANUAL ERASE FLAG BIT |
| B1 | EQUALS 0 | FIRST BAIL FROM KEYBOARD |
| B2 | EQUALS 1 | SECOND BAIL FROM KEYBOARD |
| B3 | EQUALS 2 | THIRD BAIL FROM KEYBOARD |
| P1 | EQUALS 1 | PITCH INDICATOR INPUT |

APPENDIX B

| | | | | |
|---|---|---|---|---|
| 0000 89 | START | LR | SENSOR | IS THER AN INPUT FROM KEYBOARD? |
| 0001 E000 | | TJN | STRB,START | |
| 0003 ABFF | | LBD | KBDBLS | |
| 0005 B0 | | LN | 0 | |
| 0006 85 | | LR | KBD | |
| 0007 005B | | TJE | B1,CHR | |
| 0009 045B | | TJE | B2,CHR | |
| 000B C85B | | TJE | B3,CHR | |
| 000D AB5A | | LBD | X'5A' | IS INPUT A RELOCATE? |
| 000F 401B | | CJE | ALIGN | |
| 0011 AB52 | | LBD | X'52' | IS INPUT ONE UNIT? |
| 0013 4090 | | CJE | ONE UNIT | |
| 0015 AB70 | | LBD | X'70' | IS INPUT AN ERASE? |
| 0017 404F | | CJE | ERASE | |
| 0019 20A0 | | BR | OTHERS | |
| 001B AA3C | ALIGN | LDH | X'3C' | VALUE EQUAL TO ONE INCH? |
| 001D 08 | | STR | ECNT | |
| 001E 83 | | LR | MINI | STORE CHARACTER MINI POSITION |
| 001F 07 | | STR | WK1 | |

-continued

APPENDIX B

| | | | | |
|---|---|---|---|---|
| 0020 89 | | LR | SENSOR | FIX PITCH? |
| 0021 C434 | | TJE | P1,A1 | |
| 0023 A7 | | LBR | WK1 | CARRIER ON CHACTER POSITION? |
| 0024 AA01 | | LDH | X'01' | |
| 0026 4034 | | CJE | A1 | |
| 0028 88 | A2 | LR | ECNT | ADD ONE TO ESCAPE VALUE |
| 0029 AE | | A1 | | |
| 002A 08 | | STR | ECNT | |
| 002B 87 | | LR | WK1 | |
| 002C AF | | S1 | | |
| 002D 07 | | STR | WK1 | |
| 002E AB01 | | LBD | X'01' | |
| 0030 4034 | | CJE | A1 | IS ESCAPEMENT ON CHARACTER VALUE? |
| 0032 2028 | | BR | A2 | |
| 0034 8A | A1 | LR | FLAG | TURN ON MANUAL ERASE FLAG |
| 0035 59 | | SBS | MANUAL | |
| 0036 5A | | SBS | FIRST | TURN ON FIRST TIME FLAG |
| 0037 AA80 | | LDH | X'8' | PLACE SPECIAL CODE IN MEMORY |
| 0039 A4 | | LBR | MLCNT | |
| 003A A8 | | STN | 0 | |
| 003B 86 | | LR | PM | START CARRIER BACKWARD |
| 003C 5B | | SBS | ESCMAG | |
| 003D 59 | | SBS | REVMAG | |
| 003E 89 | A3 | LR | SENSOR | LOOK FOR AN EMITTER |
| 003F E83E | | TJN | EMT,A3 | |
| 0041 88 | | LR | ECNT | |
| 0042 AF | | S1 | | |
| 0043 08 | | STR | ECNT | |
| 0044 AB00 | | LBD | X'00' | |
| 0046 404A | | CJE | A4 | IS ESCAPEMENT FINISHED? |
| 0048 203E | | BR | A3 | |
| 004A 86 | A4 | LR | PM | STOP CARRIER |
| 004B 51 | | RBS | REVMAG | |
| 004C 53 | | RBS | ESCMAG | |
| 004D 2000 | | BR | START | |
| 004F A4 | ERASE | LBR | MLCNT | GET CHARACTER OUT OF MEMORY |
| 0050 B0 | | LN | 0 | |
| 0051 AB80 | | LBD | X'80' | |
| 0053 4057 | | CJE | ER1 | SPECIAL CODE IN MEMORY |
| 0055 20A0 | | BR | OTHERS | |
| 0057 8A | ER1 | LR | FLAG | |
| 0058 59 | | SBS | MANUAL | |
| 0059 2000 | | BR | START | |
| 005B 8A | CHR | LR | FLAG | |
| 005C E48C | | TJN | MANUAL, CHR7 | MANUAL ERASE? |
| 005E C878 | | TJE | FIRST,CHR2 | FIRST MANUAL ERASE? |
| 0060 89 | | LR | SENSOR | |
| 0061 C483 | | TJE | P1,CHR5 | FIX PITCH |
| 0063 A5 | | LBR | KBD | FIND ESCAPE VALUE |
| 0064 B0 | | LN | ESCTABL | |
| 0065 08 | | STR | ECNT | |
| 0066 86 | CHR6 | LR | PM | MOVE CARRIER BACKWARD |
| 0067 5B | | SBS | ESCMAG | |
| 0068 59 | | SBS | REVMAG | |
| 0069 89 | CHR3 | LR | SENSOR | LOOK FOR EMITTERS |
| 006A E869 | | TJN | EMT,CHR3 | |
| 006C 88 | | LR | ECNT | DECREMENT COUNT |
| 006D AF | | S1 | | |
| 006E 08 | | STR | ECNT | |
| 006F AB00 | | LBD | X'0' | |
| 0071 4075 | | CJE | CHR4 | |
| 0073 2069 | | BR | CHR3 | |
| 0075 86 | CHR4 | LR | PM | STOP CARRIER |
| 0076 53 | | RBS | ESCMAG | |
| 0077 51 | | RBS | REVMAG | |
| 0078 A5 | CHR2 | LBR | KBD | FIND VELOCITY VALUE |
| 0079 B0 | | LN | VELTABL | |
| 007A 04 | | STR | VELMAG | |
| 007B 86 | | LR | PM | LIFT ERASE TAPE |
| 007C 5B | | SBS | ERTAPE | |
| 007D 85 | | LR | KBD | |
| 007E 05 | | STR | CHARMAG | ERASE CHARACTER |
| 007F 8A | | LR | FLAG | |
| 0080 51 | | RBS | MANUAL | |
| 0081 2000 | | BR | START | |
| 0083 75 | CHR5 | LDL | 5 | |
| 0084 08 | | STR | ECNT | |
| 0085 2078 | | BR | CHR2 | |
| 0087 A4 | CHR1 | LBR | MLCNT | STORE CHARACTER IN MEMORY |
| 0088 85 | | LR | KBD | |
| 0089 A8 | | STN | 0 | |

-continued

APPENDIX B

| | | | | |
|---|---|---|---|---|
| 008A 20A0 | | BR | OTHERS | |
| 008C 8A | CHR7 | LR | FLAG | |
| 008D 51 | | RBS | MANUAL | |
| 008E 2066 | | BR | CHR6 | |
| 0090 8A | ONE UNIT | LR | FLAG | IN MANUAL ERASE |
| 0091 E495 | | TJN | MANUAL,OU2 | |
| 0093 8A | | LR | FLAG | |
| 0094 5A | | SBS | FIRST | |
| 0095 86 | OU2 | LR | PM | BACK UP CARRIER |
| 0096 59 | | SBS | REVMAG | |
| 0097 5B | | SBS | ESCMAG | |
| 0098 89 | OU1 | LR | SENSOR | LOOK FOR EMITTERS |
| 0099 E898 | | TJN | EMT,OU1 | |
| 009B 86 | | LR | PM | STOP CARRIER |
| 009C 51 | | RBS | REVMAG | |
| 009D 53 | | RBS | ESCMAG | |
| 009E 2000 | | BR | START | |
| 00A0 AC | OTHERS | H | | |

APPENDIX C

| | | FIRST BYTE | | | | | | | | SECOND BYTE | | | | | | | |
|---|---|---|---|---|---|---|---|---|---|---|---|---|---|---|---|---|---|
| INSTRUCTION | MNEUMONIC | 8 | 7 | 6 | 5 | 4 | 3 | 2 | 1 | 8 | 7 | 6 | 5 | 4 | 3 | 2 | 1 |
| TEST BIT - JUMP EQUAL | TJE | 1 | 1 | 0 | B | B | B | A | A | A | A | A | A | A | A | A | A |
| TEST BIT - JUMP NOT EQUAL | TJN | 1 | 1 | 1 | B | B | B | A | A | A | A | A | A | A | A | A | A |
| COMPARE - JUMP EQUAL | CJE | 0 | 1 | 0 | 0 | A | A | A | A | A | A | A | A | A | A | A | A |
| COMPARE - JUMP LESS | CJL | 0 | 1 | 1 | 0 | A | A | A | A | A | A | A | A | A | A | A | A |
| BRANCH | BR | 0 | 0 | A | A | A | A | A | A | A | A | A | A | A | A | A | A |
| LOAD DIRECT LOW | LDL | 0 | 1 | 1 | 1 | D | D | D | D | | | | | | | | |
| LOAD DIRECT HIGH | LDH | 1 | 0 | 1 | 0 | 1 | 0 | 1 | 0 | D | D | D | D | D | D | D | D |
| LOAD REGISTER | LR | 1 | 0 | 0 | R | R | R | R | R | | | | | | | | |
| LOAD INDIRECT | LN | 1 | 0 | 1 | 1 | A | A | A | A | | | | | | | | |
| LOAD B DIRECT | LBD | 1 | 0 | 1 | 0 | 1 | 0 | 1 | 1 | D | D | D | D | D | D | D | D |
| STORE REGISTER | STR | 0 | 0 | 0 | R | R | R | R | R | | | | | | | | |
| STORE INDIRECT | STN | 1 | 0 | 1 | 0 | 1 | 0 | 0 | 0 | | | | | | | | |
| SET BIT AND STORE | SBS | 0 | 1 | 0 | 1 | 1 | B | B | B | | | | | | | | |
| RESET BIT AND STORE | RBS | 0 | 1 | 0 | 1 | 0 | B | B | B | | | | | | | | |
| INCREMENT | A1 | 1 | 0 | 1 | 0 | 1 | 1 | 1 | 0 | | | | | | | | |
| DECREMENT | S1 | 1 | 0 | 1 | 0 | 1 | 1 | 1 | 1 | | | | | | | | |
| NO OPERATION | NOP | 1 | 0 | 1 | 0 | 1 | 1 | 0 | 1 | | | | | | | | |
| EMITTER | ER | 1 | 0 | 1 | 0 | 1 | 0 | 0 | 1 | | | | | | | | |

APPENDIX D

Instruction Summary

| Mnemonic | Name | Description |
|---|---|---|
| TJE B,A | Test Bit - Jump Equal | Test bit B in the accumulator and when on, branch to A. |
| TJN B,A | Test Bit - Jump Unequal | Test bit B in the accumulator and when off branch to A. |
| CJE R,A | Compare - Jump Equal | Compare byte R in B register with accumulator and when equal branch to A. |
| CJL R,A | Compare - Jump Low | Compare accumulator to byte R in B register and when accumulator is less than R branch to A. |
| BR A | Branch | Branch to A. |
| J A | Jump | Jump to A. |
| LDL D | Load Direct Low | Load low half of the accumulator from the instruction. Zero high half. |
| LDH D | Load Direct | Load the accumulator from the instruction. |
| LR R | Load Register | Load accumulator from direct memory. Place direct memory address in storage address Register. |
| LBR R | Load B Register | Load the B Register from direct memory. |
| LN A | Load Indirect | Load the accumulator from indirect memory. (Address given by R Register and 4 bits of the instruction.) |
| STR R | Store Register | Store the accumulator in direct |

-continued

APPENDIX D

| Instruction Summary Mnemonic | Name | Description |
|---|---|---|
| | | memory. Place direct memory address. |
| STN | Store Indirect | Store the accumulator in indirect memory (Address in Register.) |
| SBS B | Set Bit and Store | Set bit B in direct memory (address in Storage Address Register) to 1. |
| RBS B | Reset Bit and Store | Set bit B in direct memory (address in Storage Address Register) to 0. |
| A1 | Increment | Add one to the accumulator. |
| S1 | Decrement | Subtract one from the accumulator. |
| NOP | No Operation | Go to next instruction. |
| ER | Emitter Reset | Reset Emitter latch. |

We claim:

1. A relocation control for an electronically controlled and operated typewriter having a keyboard, a print mechanism, a platen to support an image sheet, escapement means for moving said print mechanism, relative to said platen, in the forward and reverse direction, said print mechanism comprising a print point defining means, said control comprising:

a visual indicator maintained in spaced relation to said print point defining means; and means responsive to a keyboard control signal and without other preconditioning of said means responsive to a keyboard control signal to operate said escapement means in a reverse direction to move said print point defining means by a distance corresponding to the distance of said spaced relation directly to a point over which said visual indicator was positioned when said control signal was initiated;

said escapement means further comprising means for maintaining an indication of the position of said print point defining means, and means for determining print point positions, in uniform pitch, said means responsive to a keyboard control signal being further responsive to said escapement means to determine the misalignment of said print point defining means and said print point positions and further responsive to any such misalignment to increase said distance by sufficient additional distance to properly align said print point defining means with one of said print point positions upon completion of said operation of said escapement means.

2. The relocation control for a typewriter, of claim 1 wherein said typewriter further comprises pitch selection control means controllable to produce one of a plurality of pitch selection signals corresponding to the escapement pitch desired.

3. The relocation control of claim 2 wherein said means for determining print point positions is responsive to one of said pitch selection signals to make said print point determination in at least one of a first and a second pitch.

* * * * *